US008109715B2

(12) United States Patent
Renaud et al.

(10) Patent No.: US 8,109,715 B2
(45) Date of Patent: Feb. 7, 2012

(54) VARIABLE NOZZLE TURBOCHARGER

(75) Inventors: Philippe Renaud, Sanchey (FR); Denis Tisserant, Thaon les Vosges (FR)

(73) Assignee: Honeywell International, Inc., Morristown, NJ (US)

( * ) Notice: Subject to any disclaimer, the term of this patent is extended or adjusted under 35 U.S.C. 154(b) by 1129 days.

(21) Appl. No.: 11/667,799

(22) PCT Filed: Nov. 16, 2004

(86) PCT No.: PCT/EP2004/012992

§ 371 (c)(1), (2), (4) Date: Oct. 17, 2007

(87) PCT Pub. No.: WO2006/053579

PCT Pub. Date: May 26, 2006

(65) Prior Publication Data

US 2008/0131267 A1 Jun. 5, 2008

(51) Int. Cl.
*F01D 9/02* (2006.01)

(52) U.S. Cl. ..... 415/160; 415/191

(58) Field of Classification Search ..... 415/160, 415/191; 416/241 R

See application file for complete search history.

(56) References Cited

U.S. PATENT DOCUMENTS

| | | | | |
|---|---|---|---|---|
| 4,629,396 | A | 12/1986 | Lorett | |
| 5,299,909 | A * | 4/1994 | Wulf | 415/186 |
| 5,564,895 | A | 10/1996 | Agahi et al. | |
| 5,873,696 | A | 2/1999 | Harada et al. | |
| 6,709,232 | B1 | 3/2004 | Vogiatzis | |
| 6,755,612 | B2 * | 6/2004 | Shahpar et al. | 415/192 |
| 7,771,162 | B2 * | 8/2010 | Castan | 415/164 |
| 2002/0187061 | A1 | 12/2002 | Arnold | |

FOREIGN PATENT DOCUMENTS

| | | |
|---|---|---|
| DE | 10153301 | 5/2003 |
| EP | 1197637 | 4/2002 |
| EP | 1635038 | 3/2006 |

OTHER PUBLICATIONS

SAE Technical paper "Compressible Turbulant Flow . . .".
PCT ISR/WO Honeywell.

* cited by examiner

*Primary Examiner* — Ninh H Nguyen

(57) ABSTRACT

There is provided a turbocharger with a variable nozzle assembly having a plurality of cambered vanes positioned annularly around a turbine wheel, each vane (20) being pivotable around a pivot point (Pp) and being configured to have a leading edge (Ple) and a trailing edge (Pte) connected by an outer airfoil surface (2) and an inner airfoil surface (4), said outer airfoil surface (2) being substantially convex and said inner airfoil surface (4) having a convex section at the leading edge (Ple) which has a local extreme (Pex) of curvature and transitions into a concave section towards the trailing edge (Pte). The positions of the pivot point (Pp) and the local extreme (Pex) are set such that, even when the vanes are placed in a closed position, the exhaust gas stream exercises a positive torque on the vanes which tends to open the nozzle.

27 Claims, 5 Drawing Sheets

VARIABLE NOZZLE TURBOCHARGER

FIELD OF THE INVENTION

This invention relates generally to the field of variable nozzle turbochargers and, more particularly, to an improved vane design for a plurality of pivoting vanes within a turbine housing of the variable nozzle turbocharger.

BACKGROUND OF THE INVENTION

A variable nozzle turbocharger generally comprises a center housing having a turbine housing attached at one end, and a compressor housing attached at an opposite end. A shaft is rotatably disposed within a bearing assembly contained within the center housing. A turbine or turbine wheel is attached to one shaft end and is carried within the turbine housing, and a compressor impeller is attached to an opposite shaft end and is carried within the compressor housing.

FIG. 1 illustrates a part of a known variable nozzle turbocharger 10 including the turbine housing 12 and the center housing 32. The turbine housing 12 has an exhaust gas inlet (not shown) for receiving an exhaust gas stream and an exhaust gas outlet 16 for directing exhaust gas to the exhaust system of the engine. A volute 14 connects the exhaust inlet and a nozzle which is defined between an insert 18 and a nozzle ring 28. The insert 18 forms an outer nozzle wall and is attached to the center housing 32 such that it is incorporated in the turbine housing 12 adjacent the volute 14. The nozzle ring 28 acts as an inner nozzle wall and is fitted into the insert 18. A turbine wheel 30 is carried within the exhaust gas outlet 16 of the turbine housing 12. Exhaust gas, or other high energy gas supplying the turbocharger 10, enters the turbine wheel 30 through the exhaust gas inlet and is distributed through the volute 14 in the turbine housing 12 for substantially radial entry into the turbine wheel 30 through the circumferential nozzle defined by the insert 18 and the nozzle ring 28.

Multiple vanes 20 are mounted to the nozzle ring 28 using vane pins 22 that project perpendicularly outwardly from the vanes 20. Each vane pin 22 is attached to a Vane arm 24, and the vane arms 24 are received in a rotatably mounted unison ring 28. An actuator assembly is connected with the unison ring 26 and is configured to rotate the unison ring 26 in one direction or the other as necessary to move the vanes 20 radially, with respect to an axis of rotation of the turbine wheel 30, outwardly or inwardly to respectively increase or decrease the pressure differential and to modify the flow of exhaust gas through the turbine wheel 30. As the unison ring 26 is rotated, the vane arms 24 are caused to move, and the movement of the vane arms 24 causes the vanes 20 to pivot via rotation of the vane pins 24 and open or close a throat area of the nozzle depending on the rotational direction of the unison ring 26.

An example of a known turbocharger employing such a variable nozzle assembly is disclosed in WO 2004/022926 A.

The vanes are generally designed having an airfoil shape that is configured to both provide a complementary fit with adjacent vanes when placed in a closed position, and to provide for the passage of exhaust gas within the turbine housing to the turbine wheel when placed in an open position. Such a vane has a leading edge or nose having a first radius of curvature and a trailing edge or tail having a substantially smaller second radius of curvature connected by an inner airfoil surface on an inner side of the vane and an outer airfoil surface on an outer side of the vane. In this vane design, the outer airfoil surface is convex in shape, while the inner airfoil surface is convex in shape at the leading edge and concave in shape towards the trailing edge. The inner and outer airfoil surfaces are defined by a substantially continuous curve which complement each other. As used herein, the vane surfaces are characterized as "concave" or "convex" relative to the interior (not the exterior) of the vane. The asymmetric shape of such a vane results in a curved centerline, which is also commonly referred to as the camberline of the vane. The camberline is the line that runs through the midpoints between the vane inner and outer airfoil surfaces between the leading and trailing edges of the vane. Its meaning is well understood by those skilled in the relevant technical field. Because this vane has a curved camberline, it is a "cambered" vane.

The use of such cambered vanes in variable nozzle turbochargers has resulted in some improvement in aerodynamic effects within the turbine housing. Some particularly useful vane designs are disclosed in U.S. Pat. No. 6,709,232 B1. These vane designs reduce unwanted aerodynamic effects within the turbine housing by maintaining a constant rate of exhaust gas acceleration as exhaust gas is passed thereover, thereby reducing unwanted back-pressure within the turbine housing which is known to contribute to losses in turbocharger and turbocharged engine operating efficiencies.

Although the use of cambered vanes has resulted in some improvements in efficiency, it has been discovered that there is a risk to get a reversion of aerodynamic torque acting on the vane surface. In particular, it has been observed that there is usually a negative torque when the nozzle throat area is small and that there is a positive torque when the nozzle throat area is large. The torque is defined as positive when the flow of exhaust gas has enough force to urge the vanes into the open position. The aerodynamic torque reversion affects the functionality of the actuator assembly and the unison ring which cause the vanes to pivot. Having regard to controllability, it is preferable that the torque exercised on the vane has always the same orientation regardless of the vane position. It is even more preferable that the torque is positive and tends to open the nozzle (i.e. increase the throat area of the nozzle).

SUMMARY OF THE INVENTION

It is, therefore, desirable that a variable nozzle turbocharger be provided with improved vane operational controllability when compared to conventional turbochargers.

The inventors did extensive research to find the cause of torque reversion in a turbocharger with a variable nozzle assembly having a plurality of cambered vanes positioned annularly around a turbine wheel. They found that the predominant factors are: (a) the position of the vane pivot point, (b) the position of a local extreme of curvature in the convex section of the inner airfoil surface with respect to the pivot point, (c) the shape of the convex section of the inner airfoil surface, and (d) the flow incidence angle of exhaust gas on the vane surface.

Concerning factor (a), it was found that in a coordinate system in which the origin is the vane leading edge, the x-axis runs through the vane trailing edge and the y-axis is normal to the x-axis and runs to the outer side of the vane, it is favorable that the pivot point is located at a position which meets the following expressions:

$$0.25<Xp/C<0.45, \text{ preferably } 0.30<Xp/C<0.40;$$

and $$-0.10\leqq Yp/C\leqq 0.05, \text{ preferably } -0.10\leqq Yp/C\leqq 0, \text{ most preferably } -0.10\leqq Yp/C\leqq -0.05,$$

wherein Xp is a distance between the pivot point and the leading edge on the x-axis, C is a distance between the leading edge and the trailing edge, and Yp is a distance between the pivot point and the camberline of the vane on the y-axis, with negative values of Yp representing a pivot point which is more on the inner side of the vane. It is preferable that the pivot point is located between the outer airfoil surface and the inner airfoil surface.

Concerning factor (b), it was found that a local extreme of curvature in the convex section of the inner airfoil surface has a strong influence on the aerodynamic torque exerted on the vane, in particular if the local extreme is a maximum. It is favorable that in the above-mentioned coordinate system, the local extreme is located at a position which meets the following expression:

$$0.3<(Xp-Xex)/Xp<0.8, \text{ preferably } 0.4<(Xp-Xex)/Xp<0.7, \text{ most preferably } 0.49<(Xp-Xex)/Xp<0.60,$$

wherein Xp is a distance between the pivot point (Pp) and the leading edge (Ple) on the x-axis, and (Xex) is a distance between the local extreme (Pex) and the leading edge (Ple) on the x-axis.

Concerning factor (c), it was found that the convex section of the inner airfoil surface preferably has a somewhat longish shape. Therefore, it is favorable that in the above-mentioned coordinate system, the local extreme is located at a position which meets the following expression:

$$0.40<Yex/Xex<0.83,$$

wherein Xex is a distance between the local extreme and the leading edge on the x-axis, and Yex is a distance between the local extreme and the leading edge on the y-axis.

Concerning factor (d), it was found that when the vanes are placed in the closed position, it is favorable that the flow incidence angle of exhaust gas with respect to a line connecting the leading edge and the pivot point is 5° or more.

In accordance with the invention, the turbocharger meets at least one of the expressions discussed in connection with factors (a), (b), (c), and (d).

Further, it is preferable that the vane leading edge is defined by a circular curve having a radius r which meets the following expression:

$$0.045<r/Xp<0.08,$$

wherein Xp is a distance between the pivot point and the leading edge on the x-axis.

Still further, it is preferable that the convex section of the inner airfoil surface is defined by a composite series of curves consisting of a circular curve that defines the leading edge and transitions into a parabolic curve, and optionally a circular or elliptic curve that connects the parabolic curve and the concave section. Also, it is preferable that the outer airfoil surface is defined by a composite series of curves including a circular curve that defines the leading edge and transitions into an elliptic curve.

Finally, it is preferable that when the vanes pivot between a closed position and an open position, a ratio Rle/Rte of a radius Rle tangent to the leading edges (Ple) of the vanes (20) to a radius Rte tangent to the trailing edges (Pte) ranges from 1.03 to 1.5.

BRIEF DESCRIPTION OF THE DRAWINGS

The invention will be more clearly understood with reference to the following drawings wherein.

DETAILED DESCRIPTION OF THE INVENTION

Figure 1:
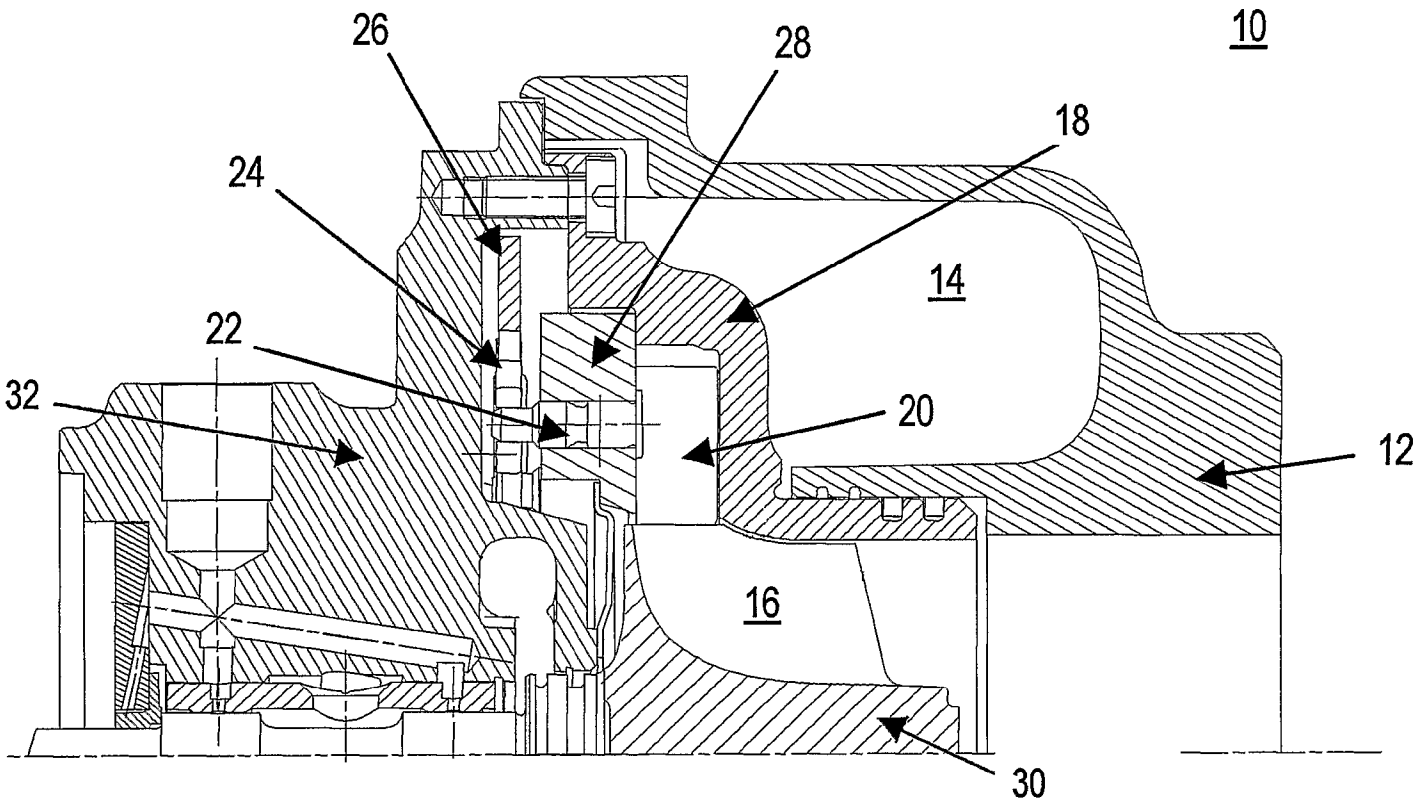
FIG. 1 is a partial cross-sectional view of a turbocharger employing a variable nozzle assembly.
Figure 2:
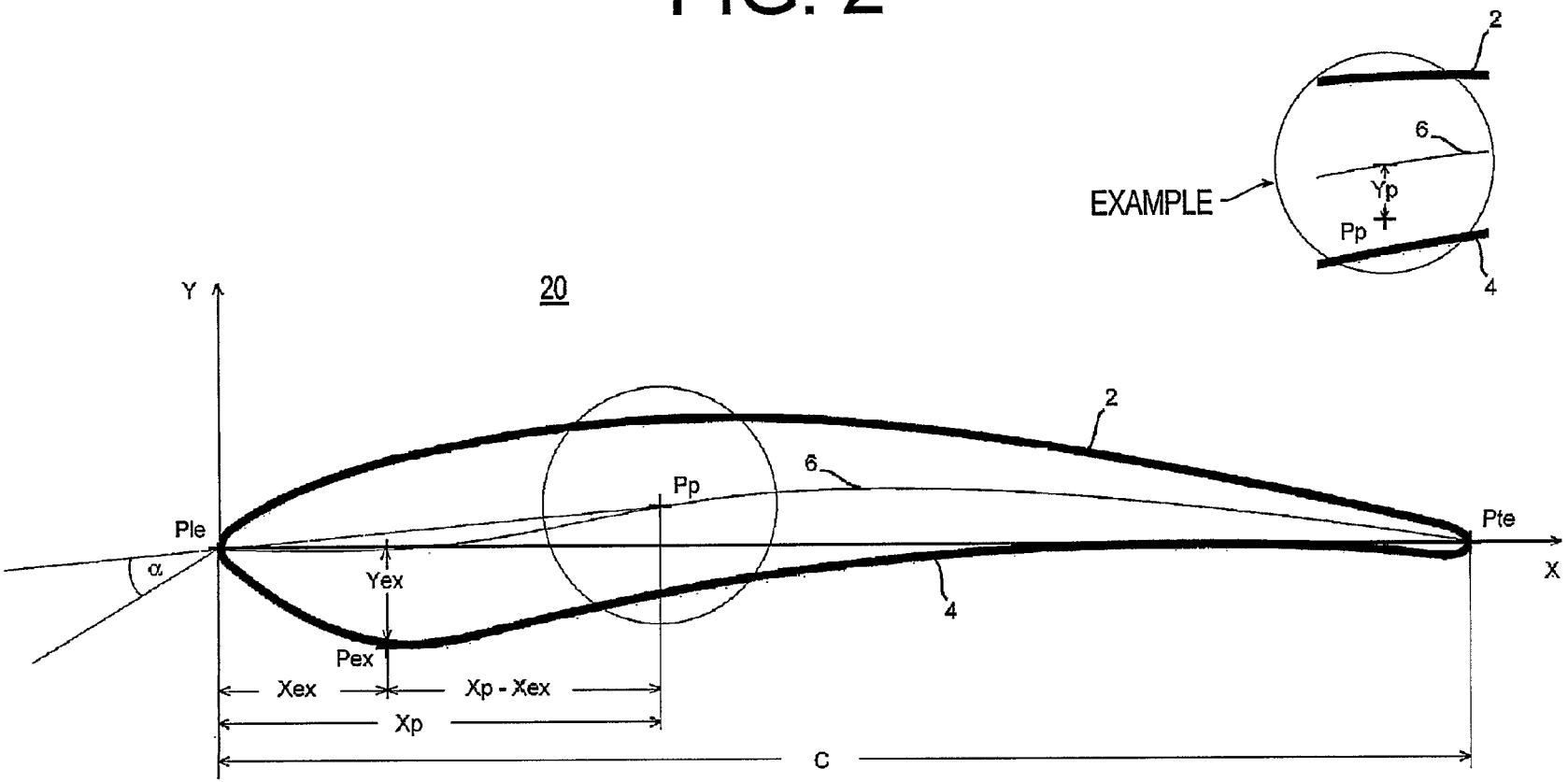
FIG. 2 is an elevational side view of a cambered vane according to an embodiment of this invention.

FIG. 2 illustrates a cambered vane 20 according to a preferred embodiment of this invention. The cambered vane 20 according to this embodiment may be used in the variable nozzle turbocharger 10 shown in FIG. 1. Other turbocharger layouts may be suitable as well.

As shown in FIG. 2, the cambered vane 20 comprises an outer airfoil surface 2 that is substantially convex in shape and that is defined by a composite series of curves, and an opposite inner airfoil surface 4 that includes convex and concave-shaped sections and that is also defined by a composite series of curves. A leading edge or nose Ple is located at one end of the vane between the inner and outer airfoil surfaces, and a trailing edge or tail Pte is located at an opposite end of the vane between the inner and outer airfoil surfaces. The leading edge Ple is defined by a circular curve having a first radius of curvature r (not shown), and the trailing edge Pte is defined by a circular curve preferably having a smaller second radius of curvature.

The vane has a certain length which is defined as the length of the chord (straight line) C that runs between the leading and trailing vane edges Ple, Pte. Furthermore, the vane has a pivot point Pp, so it can rotate.

The composite series of curves defining the outer airfoil surface 2 includes a section having the shape of a truncated ellipse for the first 10 or 20% of the vane length C and a section having a constant or decreasing radius of curvature for the rest of the vane length C. The composite series of curves defining the inner airfoil surface 4 includes a convex section that is defined by a second order polynomial for the first 20 to 30% of the vane length C and a concave section having a constant or increasing radius of curvature for almost the rest of the vane length C. The end of the convex section is marked by the inflection point. The convex section resembles a parabolic curve that potentially transitions into a short circular or elliptic curve connecting the parabolic curve and the concave section. The vertex of the parabolic curve defines a local extreme of curvature Pex. The midpoints between the inner and outer airfoil surfaces 2, 4 having the above shape define a curved camberline 6. The camberline is almost flat for the first 15 to 25% of the vane length C, at which point the camberline 6 becomes curved.

For defining the positions of the pivot point Pp and the local extreme Pex, the coordinate system shown in FIG. 2 is used. The origin of this coordinate system is the leading edge Ple. The x-axis coincides with the chord C that defines the vane length and runs between the leading and trailing vane edges Ple, Pte. The y-axis is normal to the x-axis and runs to the outer side of the vane in the direction in which the outer airfoil surface 2 extends. In this coordinate system, the pivot point Pp is located at a position which is defined by a distance Xp between the pivot point Pp and the leading edge Ple on the x-axis and a distance Yp between the pivot point Pp and the camberline 6 of the vane on the y-axis. Negative values of Yp represent a pivot point Pp which is closer to the inner airfoil surface 4 or the inner side of the vane (see example on the upper right of the drawing). The local extreme Pex is located at a position which is defined by a distance Xex between the leading edge Ple and the local extreme Pex on the x-axis and a distance Yex between the leading edge Ple and the local extreme Pex on the y-axis.

To be more specific, the vane of this embodiment has the following specifications:

$Xp/C=0.35$;

$Yp/C=0.00$;

$Xp-Xex)/Xp=0.56$ $Yex/Xex=0.50$;

$r/Xp=0.05$.

Figure 3:
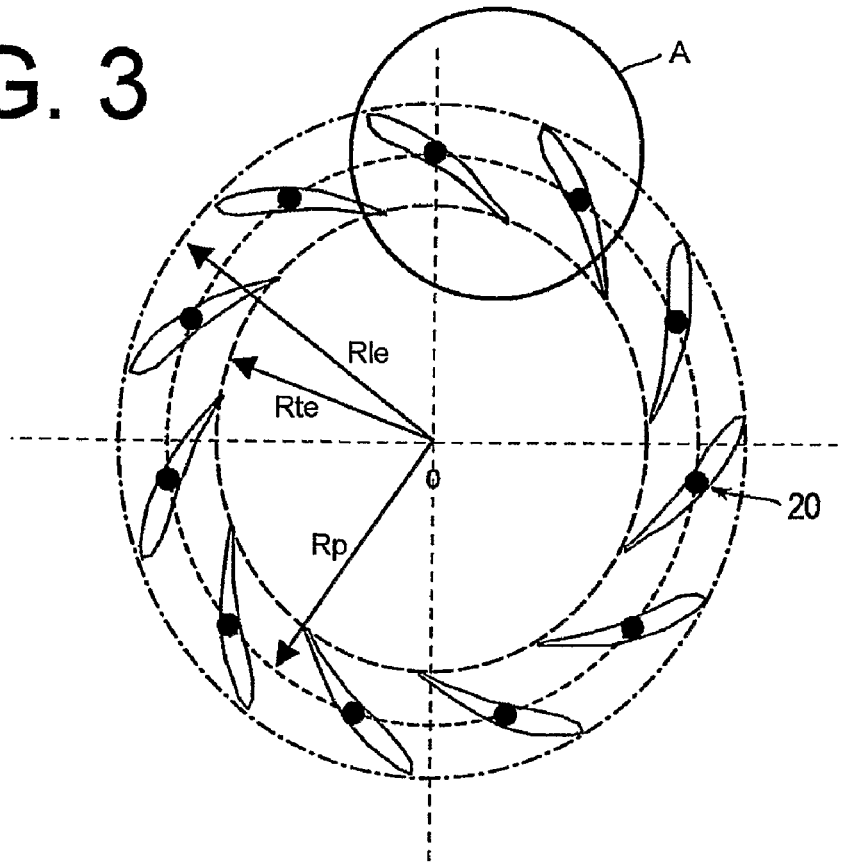
FIG. 3 shows the vane of FIG. 2 in a variable nozzle assembly of a turbocharger in cross-section.
Figure 4:
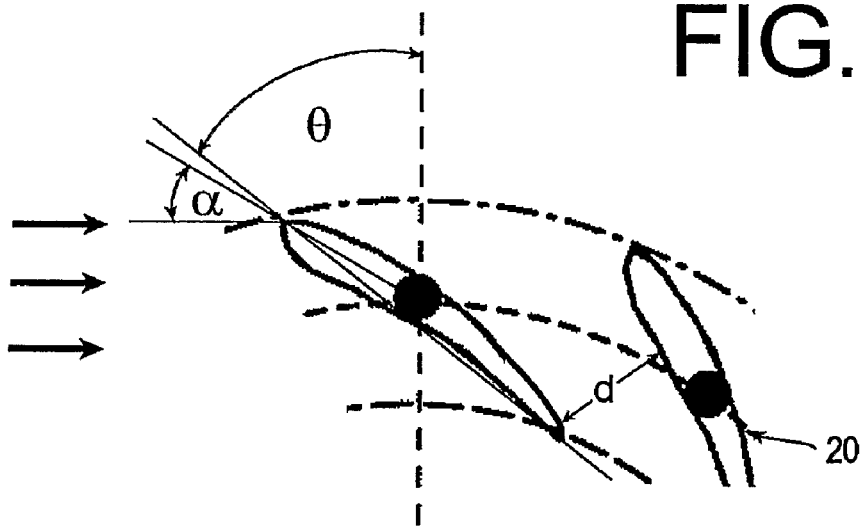
FIG. 4 shows a detail A of FIG. 3.

As illustrated in FIGS. 3 and 4, a plurality of, for example, eleven vanes 20 is disposed in the turbine housing of the turbocharger, equally spaced and radially around a turbine wheel so as to form a variable exhaust nozzle assembly. The pivot point of each vane 20 is located on a radius Rp coaxial to a radial center 0 of the variable exhaust nozzle assembly. The vanes 20 pivot between a minimum and a maximum stagger angle θ. The stagger angle θ is defined between the chord C of the vane and a straight line running between the radial center 0 of the variable exhaust nozzle assembly and the pivot point Pp of the vane. At the maximum stagger angle θ, the vanes 20 are in a closed position defining a minimum throat distance d between two adjacent vanes. At the minimum stagger angle θ, the vanes 20 are in an open position defining a maximum throat distance d. When the vanes 20 pivot between the minimum and maximum stagger angles θ, the vane leading edges Ple define a first radius Rle and the vane trailing edges Pte define a second radius Rte which is smaller than the first radius Rle.

As illustrated by the arrows in FIG. 4, the vanes 20 are disposed in the turbine housing such that that the inner airfoil surface 4 faces the exhaust gas stream. As best shown in FIG. 2, the flow incidence angle α of exhaust gas is defined with respect to a straight line running between the leading edge Ple and the pivot point Pp of the vane 20. Positive values of α tend to open the nozzle, while negative values of α tend to close the nozzle. Accordingly, the risk of an aerodynamic torque reversion affecting the controllability of the vanes 20 is the highest when the stagger angle θ is high and the flow incidence angle α is small.

It was confirmed that, in this embodiment, there is no aerodynamic torque reversion when the maximum stagger angle θ of the vane 20 is set such that the flow incidence angle α of exhaust gas is about 5°. In other words, using the vane 20 of this embodiment makes it possible to provide a variable nozzle turbocharger with improved vane operational controllability when compared to conventional turbochargers.

The inventors prepared a large number of vanes having different vane profiles and investigated the influence of the vane profile on operational controllability and turbocharger operating efficiency by using flow analysis and other methods. The aerodynamic torque was measured at two stagger angles θ near the minimum and maximum stagger angle, and the efficiency was measured at the minimum stagger angle where the throat distance d is maximum.

Figure 5:
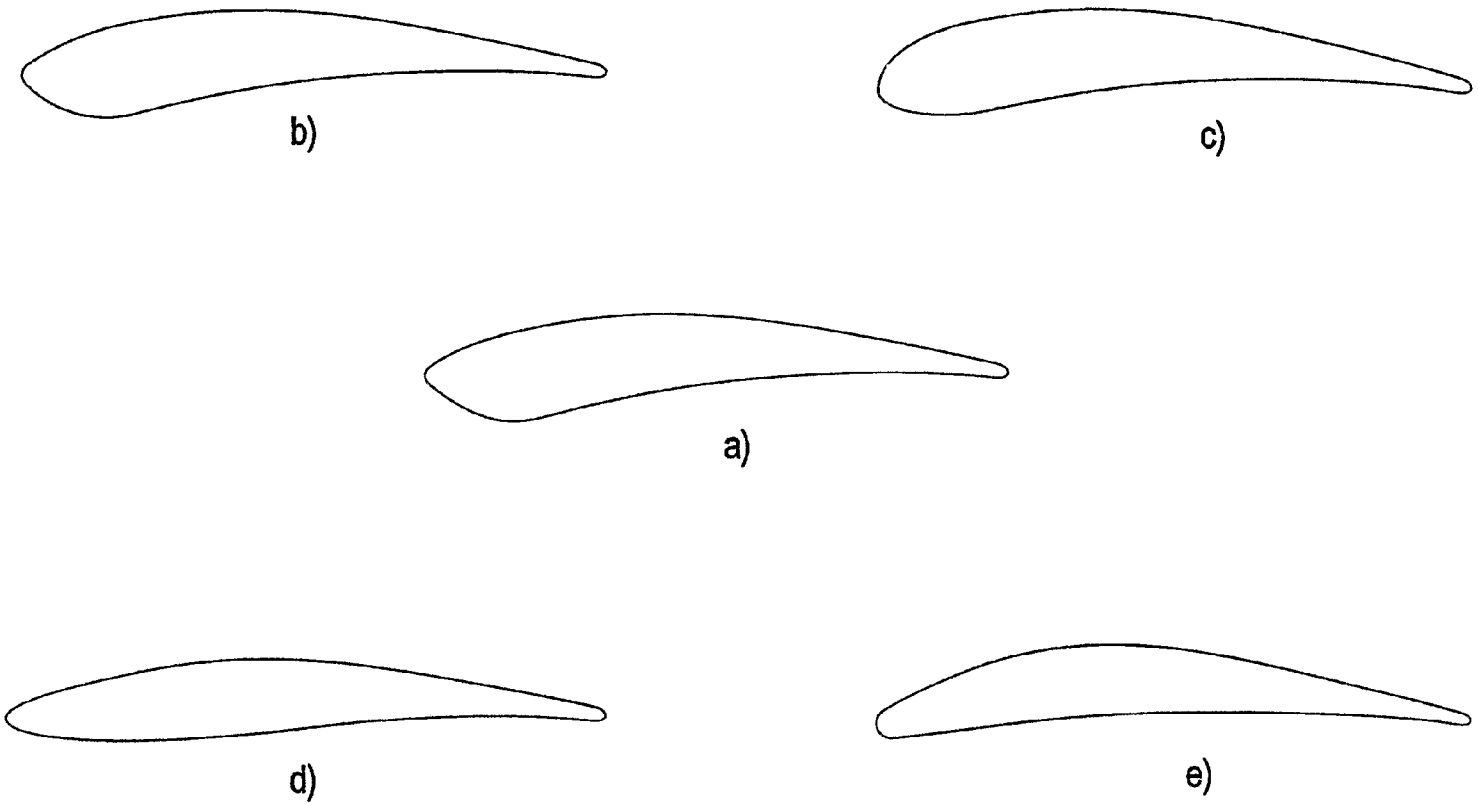
FIG. 5 shows vanes having different vane profiles.

FIG. 5 shows some examples of the vane profiles examined by the inventors. The following table gives details on the specifications. It is to be noted that Example a) is the same as the one shown in FIG. 2.

TABLE

| Example | Xp/C | Yp/C | (Xp − Xex)/Xp | Yex/Xex |
|---|---|---|---|---|
| a) | 0.35 | 0.00 | 0.56 | 0.50 |
| b) | 0.34 | 0.00 | 0.60 | 0.51 |
| c) | 0.36 | 0.00 | 0.44 | 0.19 |
| d) | 0.36 | 0.00 | 0.67 | 0.32 |
| e) | 0.37 | 0.00 | 0.94 | 1.04 |

Among the vane profiles shown in FIG. 5, Example a) exhibited both excellent controllability and excellent efficiency when mounted in a turbocharger. The controllability of Example b) was as good as the controllability of Example a), but the efficiency, though still being good, was somewhat reduced. Example c) was best in controllability but exhibited only fair efficiency. Example d) was best in efficiency but controllability was not sufficient. Example e) had controllability as poor as Example d) and efficiency similar to Example c). It follows that Example a) corresponding to the vane shown in FIG. 2 is the best compromise between the needs for good controllability and good efficiency. However, Examples b) and c) meet the needs as well.

Altogether, the tests revealed best results for vanes having the local extreme Pex located at about half way between the leading edge Ple and the pivot point Pp. In particular, it is preferred that the local extreme Pex is located at a position where the distance Xex between the local extreme Pex and the leading edge Ple on the x-axis meets the expression $0.3<(Xp-Xex)/Xp<0.8$, preferably $0.4<(Xp-Xex)/Xp<0.7$, and most preferably $0.49<(Xp-Xex)/Xp<0.60$.

Also, it was found that the local extreme Pex is preferably located such that the convex section of the inner airfoil surface 2 has a somewhat longish shape. In particular, it is favorable that the local extreme is located at a position Xex, Yex where the respective distances Xex and Yex between the local extreme Pex and the leading edge Ple on the x-axis and the y-axis meet the expression $0.40<Yex/Xex<0.83$.

Moreover, the inventors prepared a number of vanes having the same shape as the vane 20 shown in FIG. 2 but having the pivot point Pp located at different positions Xp, Yp. Again, aerodynamic torque was measured at two stagger angles θ1 and θ2 near the minimum and maximum stagger angle, respectively, and efficiency was measured at the minimum stagger angle where the throat distance d is maximum. The results of these tests are shown in FIG. 6.

Figure 6:
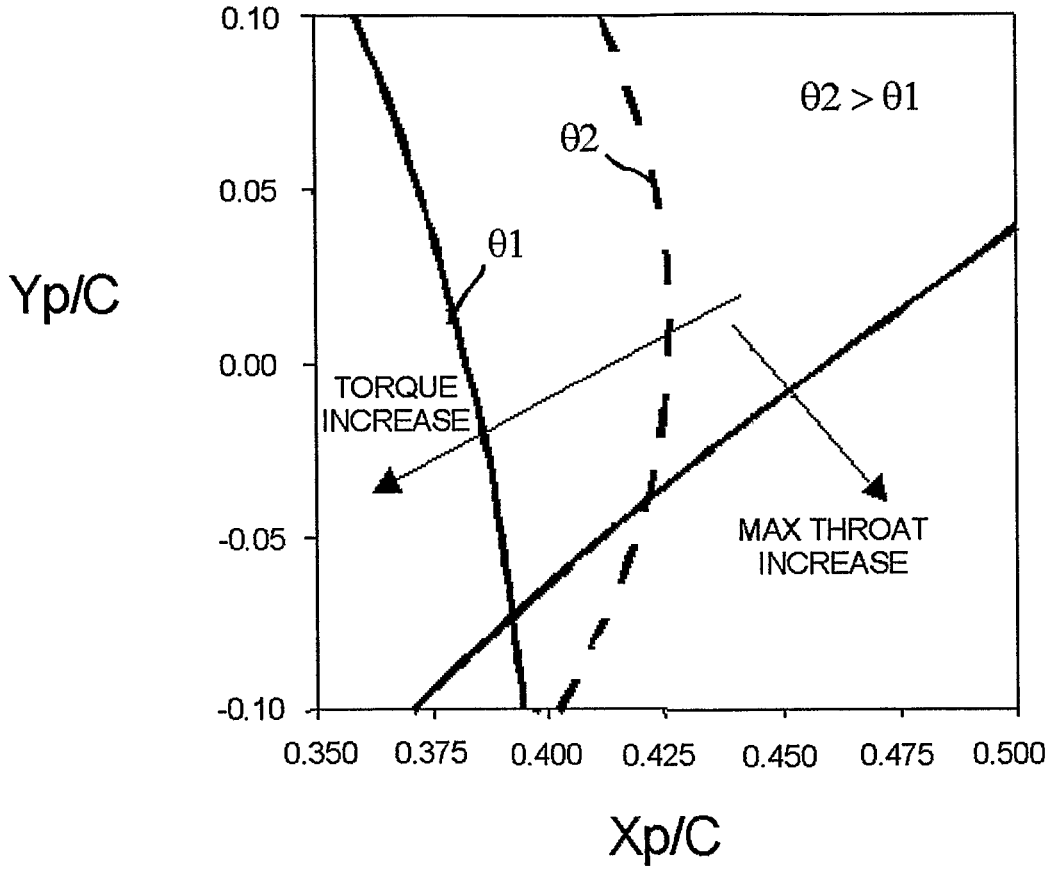
FIG. 6 is a diagram showing the combined effect of varying the pivot point for a given vane profile on aerodynamic torque and maximum nozzle throat area.

In FIG. 6, the left side of the two vertical lines corresponding to the stagger angles θ1 and θ2 defines the area of positive torque, and the lower right of the oblique curve the area of increasing maximum nozzle throat area. It follows that it is possible to achieve a desired positive torque if the distance Xp between the pivot point Pp and the leading edge Ple on the x-axis and the vane length C meet the expression $Xp/C<0.45$. However, the smaller Xp/C is the smaller is the maximum nozzle throat area and thus the turbocharger and turbocharged engine operating efficiencies. Therefore, it is preferable that Xp/C is more than 0.25. More preferably, Xp and C meet the expression $0.30<Xp/C<0.40$.

Furthermore, FIG. 6 shows that the distance Yp between the pivot point Pp and the camberline 6 of the vane 8 on the y-axis has some impact on aerodynamic torque and efficiency as well. The closer the pivot point Pp to the inner airfoil surface 4 is, the more the maximum nozzle throat area is increased. If the pivot point Pp is located below the camberline 6 on the inner side of the vane, the risk of an aerodynamic torque reversion at high stagger angles θ is further reduced. Therefore, it is favorable that the pivot point Pp is located at a position meeting the expression $-0.10\leqq Yp/C\leqq 0.05$, preferably $-0.10 \leqq Yp/C \leqq 0$, most preferably $-0.10 \leqq Yp/C \leqq -0.05$. Be that is it may, constructional requirements may be against locating the pivot point Pp outside the outer and inner airfoil surfaces 2, 4.

Moreover, the inventors investigated the influence of the flow incidence angle $\alpha$ of exhaust gas in terms of aerodynamic torque. Using the vane 20 shown in FIG. 2, it was found that the risk of aerodynamic torque reversion can be minimized if the flow incidence angle $\alpha$ of exhaust gas with respect to the line connecting the leading edge Ple and the pivot point Pp of the vane is set at the maximum stagger angle $\theta$ such that it is 5° or more. This in contrast to conventional turbochargers where the flow incidence angle $\alpha$ of exhaust gas is usually between 0° and 3° at the maximum stagger angle $\theta$ of the vanes.

Although the above findings are considered the key features for defining the cambered vane of this invention, there are other features that affect the controllability of the vanes.

It was found that the radius r defining the circular curve of the leading edge Ple and the distance Xp between the pivot point Pp and the leading edge Ple on the x-axis preferably meet the expression $0.045 < r/Xp < 0.08$. Setting the radius r within this range reduces the sensitivity of the vane against variation of flow incidence.

Further, it was confirmed that it is favorable to set the minimum and maximum stagger angles $\theta$ of the vane such that the ratio Rle/Rte of the radius Rle tangent to the vane leading edges Ple to the radius Rte tangent to the vane trailing axis Pte range from 1.03 to 1.5. This is in contrast to conventional turbochargers where the typical range Rle/Rte is between 1.05 and 1.7.

Also, it was found that the shape of the convex section of the inner airfoil surface 4 is not restricted to a parabolic curve or a curve having a local maximum between the leading edge Ple and the inflection point marking the transition to the concave section, but that a second order polynomial having a local minimum is suitable as well. However, a local maximum is preferred.

The invention claimed is:

1. A turbocharger with a variable nozzle assembly having a plurality of cambered vanes positioned annularly around a turbine wheel, each vane being pivotable around a pivot point and being configured to have a leading edge and a trailing edge connected by an outer airfoil surface on an outer side of the vane and an inner airfoil surface on an inner side of the vane, said outer airfoil surface being substantially convex and said inner airfoil surface having a convex section at the leading edge which has a local extreme of curvature and transitions into a concave section towards the trailing edge, characterized in that in a coordinate system in which the origin is the leading edge, the x-axis runs through the trailing edge and the y-axis is normal to the x-axis and runs to the outer side of the vane, said pivot point is located at a position which meets the following expressions:

$$0.25 < Xp/C < 0.45, \text{ and}$$

$$-0.10 \leqq Yp/C \leqq 0.05,$$

wherein Xp is a distance between the pivot point and the leading edge on the x-axis, C is a distance between the leading edge and the trailing edge, and Yp is a distance between the pivot point and a camberline of the vane on the y-axis, with negative values of Yp representing a pivot point which is more on the inner side of the vane.

2. A turbocharger according to claim 1, wherein Yp is set such that the pivot point is located between the outer airfoil surface and the inner airfoil surface.

3. A turbocharger according to claim 2, wherein said local extreme is located at a position which meets the following expression:

$$0.3 < (Xp - Xex)/Xp < 0.8,$$

wherein Xex is a distance between the local extreme and the leading edge on the x-axis.

4. A turbocharger according to claim 1, wherein said local extreme is located at a position which meets the following expression:

$$0.3 < (Xp - Xex)/Xp < 0.8,$$

wherein Xex is a distance between the local extreme and the leading edge on the x-axis.

5. A turbocharger according to claim 1, wherein said local extreme is located at a position which meets the following expression:

$$0.40 < Yex/Xex < 0.83,$$

wherein Xex is a distance between the local extreme and the leading edge on the x-axis and Yex is a distance between the local extreme and the leading edge on the y-axis.

6. A turbocharger according to claim 1, wherein when the vanes are placed in a closed position, a flow incidence angle of exhaust gas with respect to a line connecting the leading edge and the pivot point is 5° or more.

7. A turbocharger according to claim 1, wherein the leading edge is defined by a circular curve having a radius r which meets the following expression:

$$0.045 < r/Xp < 0.08,$$

wherein Xp is a distance between the pivot point and the leading edge on the x-axis.

8. A turbocharger according to claim 1, wherein the convex section of said inner airfoil surface is defined by a composite series of curves consisting of a circular curve that defines the leading edge and transitions into a parabolic curve, and optionally a circular or elliptic curve that connects the parabolic curve and the concave section.

9. A turbocharger according to claim 1, wherein said outer airfoil surface is defined by a composite series of curves including a circular curve that defines the leading edge and transitions into an elliptic curve.

10. A turbocharger according to claim 1, wherein when the vanes pivot between a closed position and an open position, a ratio Rle/Rte of a radius Rle tangent to the leading edges of the vanes to a radius Rte tangent to the trailing edges ranges from 1.03 to 1.5.

11. A turbocharger according to claim 1, wherein said pivot point is located at a position that meets the following expressions:

$$0.30 < Xp/C < 0.40; \text{ and } -0.10 \leqq Yp/C \leqq 0.$$

12. A turbocharger according to claim 11, wherein the Yp/C location of said pivot point is located at a position that meets the following expression:

$$-0.10 \leqq Yp/C \leqq -0.05.$$

13. A turbocharger according to claim 1, wherein said local extreme is located at a position which meets the following expression:

$$0.4 < (Xp - Xex)/Xp < 0.7.$$

14. A turbocharger according to claim 13, wherein said local extreme is located at a position which meets the following expression:

$$0.49<(Xp-Xex)/Xp<0.60.$$

15. A turbocharger with a variable nozzle assembly having a plurality of cambered vanes positioned annularly around a turbine wheel, each vane being pivotable around a pivot point and being configured to have a leading edge and a trailing edge connected by an outer airfoil surface on an outer side of the vane and an inner airfoil surface on an inner side of the vane, said outer airfoil surface being substantially convex and said inner airfoil surface having a convex section at the leading edge which has a local extreme of curvature and transitions into a concave section towards the trailing edge, characterized in that in a coordinate system in which the origin is the leading edge, the x-axis runs through the trailing edge and the y-axis is normal to the x-axis and runs to the outer side of the vane, said local extreme is located at a position which meets the following expression:

$$0.3<(Xp-Xex)/Xp<0.8,$$

wherein Xp is a distance between the pivot point and the leading edge on the x-axis, and Xex is a distance between the local extreme and the leading edge on the x-axis.

16. A turbocharger according to claim 15, wherein said local extreme is located at a position which meets the following expression:

$$0.4<(Xp-Xex)/Xp<0.7.$$

17. A turbocharger according to claim 16, wherein said local extreme is located at a position which meets the following expression:

$$0.49<(Xp-Xex)/Xp<0.60.$$

18. A turbocharger with a variable nozzle assembly having a plurality of cambered vanes positioned annularly around a turbine wheel, each vane being pivotable around a pivot point and being configured to have a leading edge and a trailing edge connected by an outer airfoil surface on an outer side of the vane and an inner airfoil surface on an inner side of the vane, said outer airfoil surface being substantially convex and said inner airfoil surface having a convex section at the leading edge which has a local extreme of curvature and transitions into a concave section towards the trailing edge, characterized in that in a coordinate system in which the origin is the leading edge, the x-axis runs through the trailing edge and the y-axis is normal to the x-axis and runs to the outer side of the vane, said local extreme is located at a position which meets the following expression:

$$0.40<Yex/Xex<0.83,$$

wherein Xex is a distance between the local extreme and the leading edge on the x-axis and Yex is a distance between the local extreme and the leading edge on the y-axis.

19. A turbocharger according to claim 18, wherein the leading edge is defined by a circular curve having a radius r which meets the following expression:

$$0.045<r/Xp<0.08,$$

wherein Xp is a distance between the pivot point and the leading edge on the x-axis.

20. A turbocharger according to claim 18, wherein the convex section of said inner airfoil surface is defined by a composite series of curves consisting of a circular curve that defines the leading edge and transitions into a parabolic curve, and optionally a circular or elliptic curve that connects the parabolic curve and the concave section.

21. A turbocharger according to claim 18, wherein said outer airfoil surface is defined by a composite series of curves including a circular curve that defines the leading edge and transitions into an elliptic curve.

22. A turbocharger according to claim 18, wherein when the vanes pivot between a closed position and an open position, a ratio Rle/Rte of a radius Rle tangent to the leading edges of the vanes to a radius Rte tangent to the trailing edges ranges from 1.03 to 1.5.

23. A turbocharger with a variable nozzle assembly having a plurality of cambered vanes positioned annularly around a turbine wheel, each vane being pivotable around a pivot point and being configured to have a leading edge and a trailing edge connected by an outer airfoil surface on an outer side of the vane and an inner airfoil surface on an inner side of the vane, said outer airfoil surface being substantially convex and said inner airfoil surface having a convex section at the leading edge which transitions into a concave section towards the trailing edge, characterized in that when the vanes are placed in a closed position, a flow incidence angle of exhaust gas with respect to a line connecting the leading edge and the pivot point is 5° or more.

24. A turbocharger according to claim 23, wherein the leading edge is defined by a circular curve having a radius r which meets the following expression:

$$0.045<r/Xp<0.08,$$

wherein Xp is a distance between the pivot point and the leading edge on the x-axis.

25. A turbocharger according to claim 23, wherein the convex section of said inner airfoil surface is defined by a composite series of curves consisting of a circular curve that defines the leading edge and transitions into a parabolic curve, and optionally a circular or elliptic curve that connects the parabolic curve and the concave section.

26. A turbocharger according to claim 23, wherein said outer airfoil surface is defined by a composite series of curves including a circular curve that defines the leading edge and transitions into an elliptic curve.

27. A turbocharger according to claim 23, wherein when the vanes pivot between a closed position and an open position, a ratio Rle/Rte of a radius Rle tangent to the leading edges of the vanes to a radius Rte tangent to the trailing edges ranges from 1.03 to 1.5.

* * * * *